US010085918B1

(12) United States Patent
Dartt et al.

(10) Patent No.: US 10,085,918 B1
(45) Date of Patent: Oct. 2, 2018

(54) SYSTEMS AND METHODS FOR TRACKING USAGE OF MEDICATIONS AND OTHER ITEMS IN CONTAINERS

(71) Applicants: Jennifer Jo Dartt, Austin, TX (US); Kevin Roger Dartt, Austin, TX (US)

(72) Inventors: Jennifer Jo Dartt, Austin, TX (US); Kevin Roger Dartt, Austin, TX (US)

(73) Assignees: Jennifer Jo Dartt, Austin, TX (US); Kevin Roger Dartt, Austin, TX (US)

( * ) Notice: Subject to any disclaimer, the term of this patent is extended or adjusted under 35 U.S.C. 154(b) by 52 days.

(21) Appl. No.: 15/339,765

(22) Filed: Oct. 31, 2016

(51) Int. Cl.
*A61J 7/04* (2006.01)
*A61J 1/03* (2006.01)

(52) U.S. Cl.
CPC . *A61J 7/04* (2013.01); *A61J 1/03* (2013.01); *A61J 2200/30* (2013.01); *A61J 2205/40* (2013.01)

(58) Field of Classification Search
CPC .. A61J 7/04; A61J 1/03; A61J 2200/30; A61J 2205/40
USPC ..... 116/201, 298, 306–308, 327, DIG. 1; 40/111, 113, 310, 311
See application file for complete search history.

(56) References Cited

U.S. PATENT DOCUMENTS 579,474 A * 3/1897 Barry ..... A61J 7/04 116/308
1,057,296 A * 3/1913 Takenaga ..... G09F 3/04 40/310
2,833,064 A * 5/1958 Parker ..... A61J 7/04 116/306
3,316,709 A * 5/1967 Edwards ..... G04B 19/22 203/21
3,706,626 A * 12/1972 Smith et al. ..... G09F 3/10 156/268
3,757,441 A * 9/1973 Baustin ..... A61J 7/04 116/308
4,048,736 A * 9/1977 Castleman ..... B65D 65/40 428/500
4,752,087 A * 6/1988 Weisbach ..... A61J 7/04 206/102
4,819,352 A * 4/1989 Maunand ..... G09B 29/001 40/107
4,913,083 A * 4/1990 Valvo ..... A61J 7/04 116/201
5,227,209 A * 7/1993 Garland ..... B44C 1/1741 206/447
5,462,783 A * 10/1995 Esselmann ..... B42F 21/00 283/36
5,660,138 A * 8/1997 Hirsch ..... A61J 7/04 116/308
5,881,597 A * 3/1999 Brooks ..... G01F 19/00 73/428
5,979,698 A * 11/1999 Deal ..... A61J 7/04 116/205

(Continued)

*Primary Examiner* — R. A. Smith
*Assistant Examiner* — Tania Courson
(74) *Attorney, Agent, or Firm* — Mark L. Berrier

(57) ABSTRACT

Systems and methods for easily tracking medication usage. In one embodiment, a product comprises an adhesive-backed strip that has a set of tracking tabs. The strip is affixed to a medication container such as a pill bottle. The tabs have corresponding identifiers (e.g., days of the week) that are printed on them. When a dose of the medication is taken, the tab corresponding to that dose is torn off of the strip to provide an indication that the dose has been taken.

9 Claims, 3 Drawing Sheets

(56) References Cited

U.S. PATENT DOCUMENTS

| | | | | | |
|---|---|---|---|---|---|
| 6,032,609 | A * | 3/2000 | Luoma | G09F 11/23 | 116/205 |
| 6,152,067 | A * | 11/2000 | Mathison | A61J 7/04 | 116/308 |
| 6,951,353 | B2 * | 10/2005 | Kozlowski | A61J 1/035 | 116/205 |
| 7,032,535 | B2 * | 4/2006 | Halstead | G09F 3/10 | 116/308 |
| 7,387,208 | B2 * | 6/2008 | Londino | A61J 7/04 | 116/308 |
| 7,921,583 | B2 * | 4/2011 | Londino | A61J 7/04 | 116/308 |
| 8,181,371 | B2 * | 5/2012 | Londino | A61J 7/04 | 116/308 |
| 2003/0122370 | A1 * | 7/2003 | Goddard | G09F 3/02 | 283/81 |
| 2009/0109006 | A1 * | 4/2009 | Helmstetter | G11B 33/0427 | 340/309.16 |

* cited by examiner

SYSTEMS AND METHODS FOR TRACKING USAGE OF MEDICATIONS AND OTHER ITEMS IN CONTAINERS

BACKGROUND

Field of the Invention

The invention relates generally to systems and methods for tracking usage of products such as medications in containers, thereby enabling people who take various medications to be able to more easily track the use of those medications and to ensure that they take the proper dosages.

Related Art

People often have to take different medications to help them overcome illnesses or injuries. Commonly, the medications prescribed by physicians consist of pills or capsules that must be taken by the patient on a daily basis. While taking these medications may be a very simple task, the simplicity of the task may make it very easy to forget whether or not it has been done. Many of us have spent time standing in front of a medicine cabinet, trying to remember whether or not we have taken our daily dose of a medication. While in many cases this is simply an inconvenience (for example, when taking allergy medications), it may be very important in other cases to take prescription medications on a strict schedule. Further, if a patient has memory problems, it may be very difficult or even impossible for the patient to remember whether or not a dose of medication has been taken. It would therefore be desirable to provide a means to facilitate tracking of the medications that are taken by a patient.

SUMMARY OF THE INVENTION

This disclosure is directed to systems and methods for tracking medication usage with a tracking product that has deformable portions corresponding to multiple doses of the medication. The deformable portions are attached to a medication container so that when a patient uses a dose of the medication, the patient can alter a corresponding one of the deformable portions and thereby record an indication that the dose has been taken.

One embodiment comprises a medication tracking product having a body strip with face side and a reverse side. An adhesive is provided on the reverse side of the body strip so that it can be adhered to a medication container. The body strip has a set of deformable tracking portions such as tabs or bubbles connected to it. Each of the deformable tracking portions has a corresponding time identifier, such as a day of the week. The tracking product can be adhered to a medication container such as a pill bottle and, when a dose of the medication is taken, a corresponding one of the deformable tracking portions is deformed (e.g., a corresponding tab is torn off, or a corresponding bubble is crushed) to indicate that the dose has been taken.

Alternative embodiments may use different types of deformable portions (e.g., tabs, bubbles, scratch-offs, etc.), different shapes, or different materials. In some embodiments, the tracking product does not include the medication container, while in other embodiments, the tracking strip is attached to the container. Still other embodiments may include methods for making or using the tracking product. It should be noted that embodiments of the invention are not limited to use with medications, and may also be employed to track use of other items or measured amounts of a substance in a container.

BRIEF DESCRIPTION OF THE DRAWINGS

Other objects and advantages of the invention may become apparent upon reading the following detailed description and upon reference to the accompanying drawings.

Figure 1:
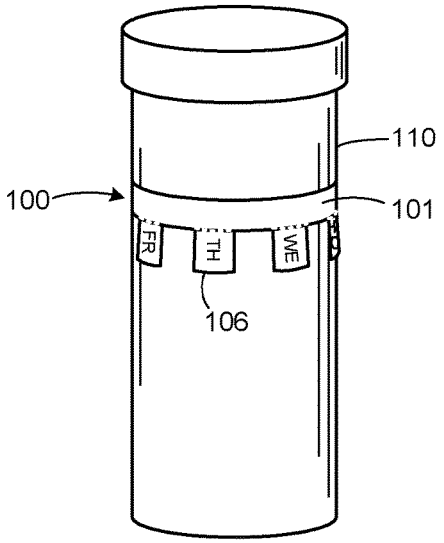
FIG. 1 is a diagram illustrating a product in which a tracking strip is attached to a pill bottle in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims. Further, the drawings may not be to scale, and may exaggerate one or more components in order to facilitate an understanding of the various features described herein.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for easily tracking medication usage. In one embodiment, a medication tracking product comprises an adhesive-backed strip that has a set of tracking tabs. The strip is affixed to a medication container such as a pill bottle. The tabs have corresponding identifiers—in this case, days of the week—that are printed on them. When a dose of the medication is taken on a particular day, the tab corresponding to that day is torn off of the strip. Later, if the patient needs to check to see whether a dose of the medication has been taken on that day, he or she simply needs to check to see whether the tab corresponding to the day has been removed. In alternative embodiments, the strip may have other forms and the tabs may be replaced with other removable or deformable components, as will be explained in more detail below.

Figure 2:
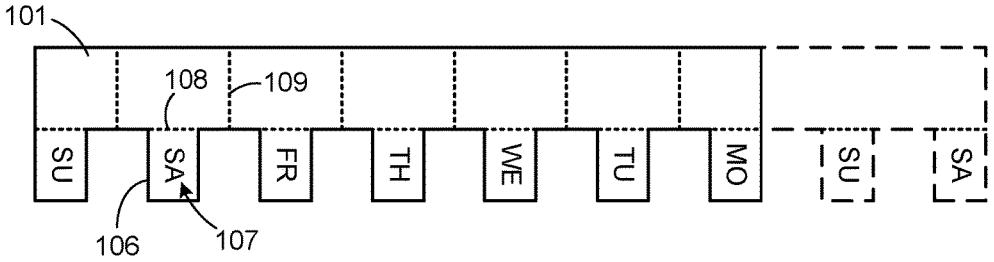
FIG. 2 is a diagram illustrating a face side of a tracking strip in accordance with one embodiment.
Figure 3:
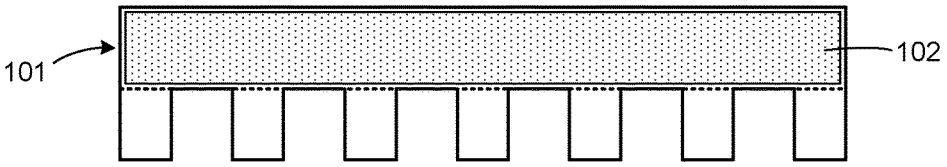
FIG. 3 is a diagram illustrating a reverse side of a tracking strip in accordance with one embodiment.
Figure 4:
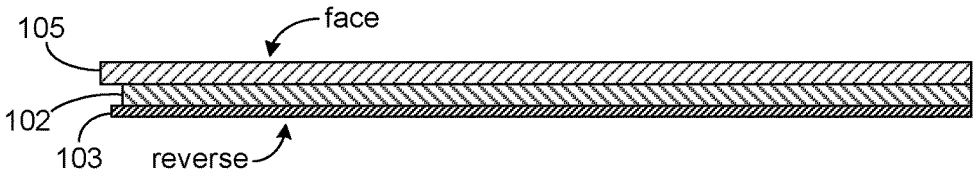
FIG. 4 is a diagram illustrating a cross-sectional view of a tracking strip in accordance with one embodiment.

Referring to FIGS. 1-4, an exemplary embodiment of the invention is shown. FIG. 1 shows a tracking strip which is attached to a pill bottle. FIG. 2 shows the front tracking strip before it is affixed to the pill bottle, while FIG. 3 shows the reverse side of the tracking strip. FIG. 4 shows a cross-section of the tracking strip which illustrates the structure of the strip.

Referring to FIG. 1, tracking product 100 is attached to a pill bottle 110. Tracking product 100 has a body strip or central portion 101 that can be affixed to pill bottle 100 by a layer of adhesive 102 that is on the reverse side of the body strip. Until tracking product 100 is affixed to the pill bottle (or another type of container), a layer of backing material 103 (e.g., paper having a non-stick coating) may be used to cover adhesive layer 102. The backing material 103 may be removed to expose adhesive layer 102 so that it can adhere the body strip to the pill bottle.

Body strip 101 may be formed by a sheet of paper 105 or any other suitable material. In this embodiment, body strip 101 is elongated and flexible, so that it can be wrapped around pill bottle 110. Preferably, however, body strip 101 is short enough that it does not overlap itself when wrapped around pill bottle 110. The body strip can, however, be placed in other positions (e.g., vertically or diagonally) if desired.

A set of tabs (e.g., 106) extend from the edge of body strip 101. Body strip 101 and tabs 106 may, for example, be die cut from a sheet of paper. In this embodiment, horizontal perforations 108 are provided between body strip 101 and tabs 106 in order to make it easier to tear the tabs from the body strip. Body strip 101 may also have vertical perforations 109 that allow the strip to be shortened if desired. For instance, if the medication need only be taken for three days, the strip can be torn along the vertical perforations so that it includes only the tabs for the three required days.

In this case, there are seven tabs, each of which is imprinted on the front or face side (with an indicator 107 of the corresponding day of the week. Alternative embodiments may be longer and may have additional tabs (as shown by the dashed line FIG. 2) so that a course of medication longer than a week can be tracked. The tabs may also have different time indicators in different embodiments for tracking medications that are taken at different intervals (e.g., monthly).

Figure 5:
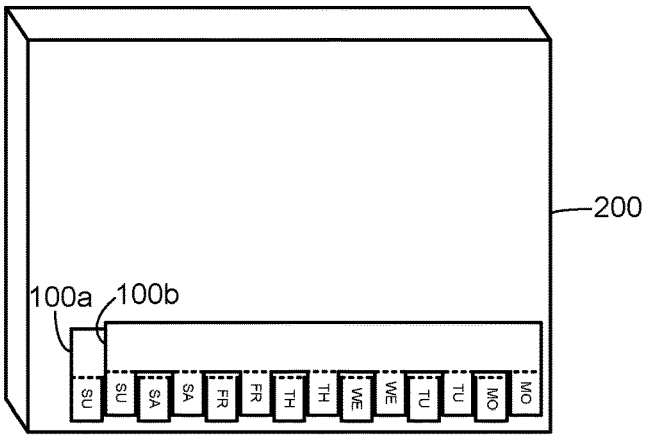
FIG. 5 is a diagram illustrating a product in which a tracking strip is attached to a box-type container in accordance with one embodiment.
Figure 6:
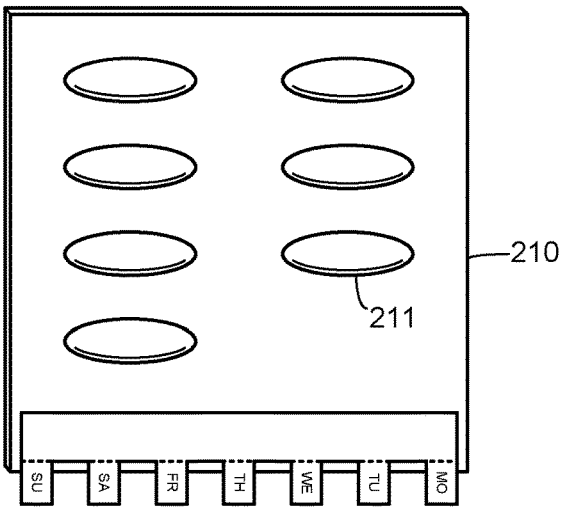
FIG. 6 is a diagram illustrating a product in which a tracking strip is attached to a card-type container in accordance with one embodiment.

While FIG. 1 shows the tracking strip attached to a pill bottle, it can be used with other types of containers as well. For instance, FIG. 5 shows the tracking strip affixed to a box 200 that may contain medication, and FIG. 6 shows the tracking strip affixed to the bottom of a card-type package 210 that holds capsules in plastic bubbles (e.g., 211). The tracking strip can also be attached to bottles for liquid medications and used to track doses of these medications.

In the example of FIG. 5, it should be noted that there are two tracking strips (100*a*, 100*b*) that are affixed to box 200. The first tracking strip 100*a* is affixed directly to the box, while tracking strip 100*b* is affixed to the box over tracking strip 100*a*. Tracking strip 100*b* is positioned so that its tabs extend downward in the spaces between the tabs of tracking strip 100*a*. The spaces between the tabs on each tracking strip are slightly greater than the width of the tabs, so that the tabs do not directly overlap and consequently do not interfere with each other. This is done to facilitate individual removal of the tabs, although it is not necessary in all embodiments. The tracking strips are positioned in this manner so that there will be two tabs for each day, rather than one, to allow tracking of twice-daily doses of medication. For example, when a dose is taken on a Monday morning, the first "Monday" tab will be torn off, and when a dose is taken on that Monday evening, the second "Monday" tab will be torn off.

Multiple tracking strips may also be used to track usage of a medication by more than one user. For instance, if several people in a family use the same allergy medication, a separate tracking strip for each person may be affixed to a single container for the medication. The tracking strip for each person may be identified by writing the person's name on the body portion of the tracking strip. Then, when a particular person takes a dose of the medication, the corresponding tab can be removed from the appropriate one of the tracking strips.

Figure 7:
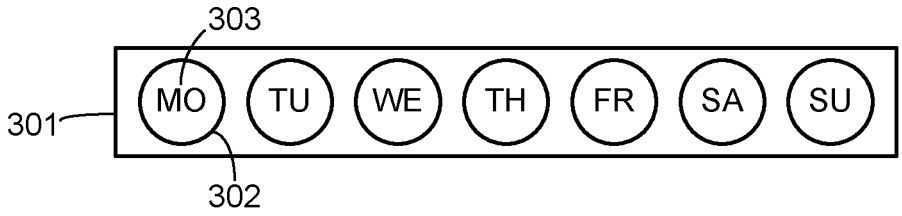
FIG. 7 is a diagram illustrating a face side of a tracking strip in accordance with an alternative embodiment.
Figure 8:
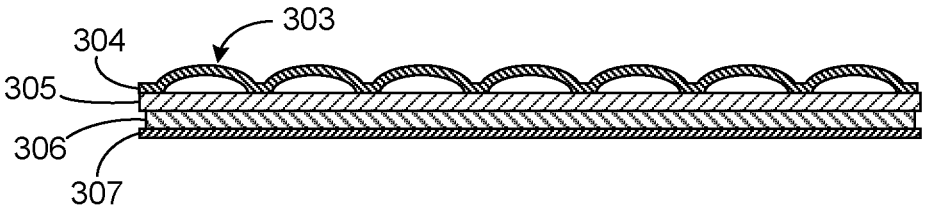
FIG. 8 is a diagram illustrating a cross-sectional view of a tracking strip in accordance with an alternative embodiment.

While the embodiments of FIGS. 1-6 use tabs that are torn from the body strip to track the already-taken doses of medication, other embodiments may use different means to track the doses. For example, the body strip may have deformable plastic bubbles formed on it, and the bubbles can be crushed or otherwise deformed to track corresponding doses of the medication. An exemplary structure is shown in FIGS. 7 and 8. In these figures, a central portion or body strip 301 is again provided. Plastic bubbles (e.g., 302) are provided over time indicator (e.g., 303). The bubbles are formed in a plastic layer 304 on the front side of a paper sheet 305 or other suitable substrate. A layer of adhesive 306 is provided on the reverse side of the substrate, and a backing material 307 covers the adhesive until the user is ready to affix the tracking strip to a medication container.

The tracking product of FIGS. 7 and 8 is used in a manner similar to the embodiments of FIGS. 1-6. Tracking strip 301 is adhered to a medication container (e.g., pill bottle, box, card, etc.) using the adhesive layer. When a dose of medication is taken, the bubble for the corresponding day (or other time period) is crushed or otherwise deformed. This can be done, for example, by depressing the bubble with a finger. The deformed bubble thereafter indicates that the corresponding dose of medication has been taken.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. A medication tracking product for use with a medication container that contains a medication comprising:

a body strip having a face side and a reverse side which is opposite the face side;

an adhesive positioned on the reverse side of the body strip, wherein the adhesive is capable of being adhered to the medication container that contains the medication; and a plurality of deformable tracking portions connected to the body strip, wherein each of the deformable tracking portions includes a corresponding time identifier, and wherein deformation of one or more of the deformable tracking portions indicates that dosages corresponding to the one or more deformed deformable tracking portions have been taken by a user;

wherein the body strip and deformable tracking portions comprise a paper sheet, wherein the paper sheet has a central portion that forms the body strip and a plurality of tabs that extend from an edge of the body strip and form the deformable tracking portions, wherein the paper sheet has perforations between the central portion and each of the tabs, wherein each of the tabs is individually deformable by tearing the paper sheet along a corresponding portion of the perforations and thereby detaching the individual tab from the paper sheet, wherein each of the tabs is separated from adjacent tabs by a space, wherein a width of the space is no less than a width of the tabs, and wherein a first one of the medication tracking product is capable of being affixed to a second one of the medication tracking product so that the tabs of the first and second ones of the medication tracking product do not overlap.

2. The medication tracking product of claim 1, wherein the body strip comprises a flexible, elongated strip, wherein the body strip is conformable to curved surfaces.

3. The medication tracking product of claim 1, wherein the adhesive comprises a layer that covers only the central portion of the paper sheet, and wherein the tabs are adhesive-free.

4. The medication tracking product of claim 1, wherein the time identifier corresponding to each deformable tracking portion comprises a visual indicator of a day of the week, wherein the visual indicator is located on the deformable tracking portion.

5. A method for tracking medication usage, the method comprising:

providing a medication container that contains a medication;

providing a first tracking product having a body strip having a face side and a reverse side which is opposite the face side, wherein the body strip has an adhesive on the reverse side and a plurality of deformable tracking portions connected to the body strip, wherein each of the deformable tracking portions includes a corresponding time identifier, wherein the body strip and deformable tracking portions comprise a paper sheet, wherein the paper sheet has a central portion that forms the body strip and a plurality of tabs that extend from an edge of the body strip and form the deformable tracking portions, wherein the paper sheet has perforations between the central portion and each of the tabs, wherein each of the tabs is individually deformable by tearing the paper sheet along a corresponding portion of the perforations and thereby detaching the individual tab from the paper sheet, wherein each of the tabs is separated from adjacent tabs by a space, wherein a width of the space is no less than a width of the tabs, and wherein a second one of the medication tracking product which is identical to the first tracking product is capable of being affixed to a first one of the medication tracking product so that the tabs of the first and second ones of the medication tracking product do not overlap;

affixing the first tracking product to the medication container by adhering the adhesive to the medication container; and when a dosage of the medication contained in the medication container is used, deforming a corresponding one of the deformable tracking portions by detaching the corresponding individual tab from the paper sheet, thereby indicating that the dosage has been taken by a user.

6. The method of claim 5, further comprising providing the second tracking product and affixing the second tracking product to the medication container with the tabs of the second tracking product positioned over the spaces between the tabs of the first tracking product.

7. A medication tracking system comprising:

a medication container that contains a medication;

a first medication tracking product having a body strip having a face side and a reverse side which is opposite the face side, wherein the body strip has an adhesive positioned on the reverse side of the body strip, wherein the first medication tracking product is adhered by the adhesive to the medication container; and a plurality of deformable tracking portions connected to the body strip, wherein each of the deformable tracking portions includes a corresponding time identifier, and wherein deformation of one or more of the deformable tracking portions indicates that dosages of medication from the medication container corresponding to the one or more deformed deformable tracking portions have been taken by a user;

wherein the body strip and deformable tracking portions comprise a paper sheet, wherein the paper sheet has a central portion that forms the body strip and a plurality of tabs that extend from an edge of the body strip and form the deformable tracking portions, wherein the paper sheet has perforations between the central portion and each of the tabs, wherein each of the tabs is individually deformable by tearing the paper sheet along a corresponding portion of the perforations and thereby detaching the individual tab from the paper sheet, wherein each of the tabs is separated from adjacent tabs by a space, wherein a width of the space is no less than a width of the tabs, and wherein a second medication tracking product is capable of being affixed to the first medication tracking product so that the tabs of the first and second medication tracking products do not overlap.

8. The medication tracking system of claim 7, wherein the medication container comprises a pill bottle.

9. The medication tracking system of claim 8, wherein a second tracking product which is identical to the first tracking product is affixed to the medication container over the first tracking product so that the tabs of the second tracking product positioned over the spaces between the tabs of the first tracking product.

* * * * *